US011378048B2

(12) United States Patent
Yohannes et al.

(10) Patent No.: US 11,378,048 B2
(45) Date of Patent: Jul. 5, 2022

(54) INTEGRATED STARTER-GENERATOR

(71) Applicant: Textron Inc., Providence, RI (US)

(72) Inventors: Zekarias W. Yohannes, Augusta, GA (US); Matthew Wilcox, Fort Worth, TX (US); David Smith, Augusta, GA (US); Brian Moebs, Augusta, GA (US); Matthew D. Wilson, Augusta, GA (US); Russell William King, Evans, GA (US)

(73) Assignee: Textron Inc., Providence, RI (US)

( * ) Notice: Subject to any disclaimer, the term of this patent is extended or adjusted under 35 U.S.C. 154(b) by 33 days.

(21) Appl. No.: 16/864,274

(22) Filed: May 1, 2020

(65) Prior Publication Data

US 2020/0256303 A1 Aug. 13, 2020

Related U.S. Application Data

(63) Continuation of application No. 16/212,190, filed on Dec. 6, 2018, now Pat. No. 10,677,211.

(51) Int. Cl.

| | |
|---|---|
| ***F02N 11/08*** | (2006.01) |
| ***F02N 19/00*** | (2010.01) |
| ***F02N 11/04*** | (2006.01) |
| *F02P 5/00* | (2006.01) |
| *F02P 5/04* | (2006.01) |

(52) U.S. Cl.

CPC ..... *F02N 11/0803* (2013.01); *F02N 11/04* (2013.01); *F02N 11/087* (2013.01); *F02N 19/004* (2013.01); *F02N 19/005* (2013.01); *F02N 2019/008* (2013.01); *F02P 5/00* (2013.01); *F02P 5/04* (2013.01)

(58) Field of Classification Search

CPC ..... F02N 11/04; F02N 11/0803

See application file for complete search history.

(56) References Cited

U.S. PATENT DOCUMENTS

| | | | | |
|---|---|---|---|---|
| 5,787,705 | A * | 8/1998 | Thoreson | F01N 9/005 60/274 |
| 6,202,497 | B1 * | 3/2001 | Kuragaki | F02N 15/067 74/6 |
| 7,239,032 | B1 * | 7/2007 | Wilson | F02N 11/04 290/31 |
| 7,400,053 | B2 | 7/2008 | Wilson et al. | |
| 9,102,205 | B2 * | 8/2015 | Kvien | B60G 7/001 |
| 9,758,040 | B1 * | 9/2017 | Reid | F02D 41/021 |

(Continued)

*Primary Examiner* — Erez Gurari

(74) *Attorney, Agent, or Firm* — Sandberg Phoenix & von Gontard P.C.

(57) ABSTRACT

A prime mover for a lightweight vehicle comprising an internal combustion engine, a starter motor integrally integrated with the internal combustion engine, and a housing for the prime mover. The prime mover additionally comprises a Hall Effect sensor and an prime mover control module structured and operable to communicate with the Hall Effect sensor, determine when operation of the internal combustion engine should cease, and upon the determination that operation of the internal combustion engine should cease, utilize the communication from the Hall Effect sensor to stop the internal combustion engine such that a piston of the internal combustion engine is positioned at between 15° and 25° after bottom-dead-center.

8 Claims, 2 Drawing Sheets

(56) References Cited

U.S. PATENT DOCUMENTS

2002/0053838 A1* 5/2002 Okuda ..... F02N 11/04 310/59
2004/0163634 A1* 8/2004 Lewis ..... F02D 41/32 123/677
2006/0201468 A1* 9/2006 Lancaster ..... F02D 11/10 123/179.5
2007/0017466 A1* 1/2007 Leppanen ..... F02N 15/006 123/179.25
2007/0215089 A1* 9/2007 Grand ..... F02N 15/046 123/179.25
2008/0023240 A1* 1/2008 Sunsdahl ..... B60K 5/00 180/68.2
2008/0173170 A1* 7/2008 Zauner ..... F02F 7/0068 92/261
2008/0246285 A1 10/2008 Asada
2009/0143188 A1* 6/2009 Soliman ..... B60W 10/02 477/5
2009/0233757 A1* 9/2009 Soliman ..... B60W 10/10 477/3
2009/0233758 A1* 9/2009 Soliman ..... B60W 10/113 477/3
2009/0284087 A1* 11/2009 Takahashi ..... H02K 7/1815 310/62
2010/0041512 A1* 2/2010 Silveri ..... B60K 6/52 477/3
2011/0132330 A1* 6/2011 Pursifull ..... F02N 19/00 123/478
2012/0193163 A1* 8/2012 Wimpfheimer ..... B62D 21/183 180/233
2013/0008401 A1* 1/2013 Lee ..... F02N 11/04 123/179.25
2013/0252774 A1* 9/2013 Suntharalingam ..... B60K 6/365 475/5
2014/0014064 A1* 1/2014 Kawasumi ..... F02N 19/005 123/311
2015/0219056 A1* 8/2015 Boesch ..... F02N 11/003 701/112
2016/0281597 A1* 9/2016 Kase ..... F02N 3/02
2017/0268655 A1* 9/2017 Stocks ..... F16H 9/14
2017/0335815 A1* 11/2017 Burrahm ..... F01M 1/02
2018/0126978 A1* 5/2018 Jerger ..... B60W 30/18127
2018/0229712 A1* 8/2018 Shelton ..... B60W 20/19
2018/0304747 A1* 10/2018 Vollmer ..... B60K 25/02
2019/0023115 A1* 1/2019 Mackenzie ..... B60K 6/42
2020/0256303 A1* 8/2020 Yohannes ..... F02N 11/0803
2020/0369278 A1* 11/2020 McBride ..... B60K 6/28

* cited by examiner

INTEGRATED STARTER-GENERATOR

CROSS-REFERENCE TO RELATED APPLICATIONS

This application is a continuation of U.S. patent application Ser. No. 16/212,190 filed on Dec. 6, 2018. The disclosure of the above application is incorporated herein by reference in its entirety.

FIELD

The present teachings relate to starters for engine in lightweight utility vehicles such as golf cars, and more particularly, to a starter-generator that integrated with the respective engine to be started.

BACKGROUND

The statements in this section merely provide background information related to the present disclosure and may not constitute prior art.

Traditionally, golf and utility vehicles that utilize the accelerator pedal to start the vehicle engine use a starter motor (that in most instances is also a generator) that is mechanically coupled to the vehicle engine. Particularly, such typical vehicle engine starter systems comprise a DC motor/generator, and a drive belt and pulleys that mechanically couple the DC motor/generator to a flywheel of the vehicle engine. The flywheel is connected to a crankshaft of the vehicle engine. In such instances, the DC motor/generator is activated, via a pedal switch, to rotate the drive belt and pulleys, which in turn rotates the engine flywheel, which in turn rotates the engine crankshaft to start the vehicle engine. Hence, the traditional vehicle engine starter systems comprise a large number of components, that in most instances, have a finite service life, and need frequent maintenance and repair. Additionally, the components of the traditional starter system can be a source to additional engine noise because of their design and applications.

SUMMARY

In various embodiments, the present disclosure provides a prime mover for a lightweight vehicle, wherein the prime mover is structured and operable to generate and deliver power to a driveline of the lightweight vehicle to provide motive force to the lightweight vehicle. In various embodiments, the prime mover comprises an internal combustion engine that is structured and operable to generate the power delivered to the driveline, a starter motor integrally integrated with the internal combustion engine, wherein the integrated starter motor is structured and operable to start the internal combustion engine, and a housing for the prime mover. In various instances the housing comprises an internal combustion engine portion that encloses at least a portion of the internal combustion engine, and a starter motor portion that encloses the integrated starter motor. In various embodiments, the starter motor portion of the housing comprises a shroud that is integrally formed with, or connected to, the internal combustion engine portion of the housing, and a cover connectable to the shroud to enclose the starter motor therebetween. In various implementations, the prime mover additionally comprises a Hall Effect sensor mounted to the combustion engine portion of the housing within the starter motor portion shroud, and a prime mover control module. The prime mover control module is structured and operable to communicate with the Hall Effect sensor, determine when operation of the internal combustion engine should start; and upon the determination that operation of the internal combustion engine should start, utilize the communication from the Hall Effect sensor to stop the internal combustion engine such that a piston of the internal combustion engine is positioned at between 15° and 25° after bottom-dead-center.

In various other embodiments, the present disclosure provides a lightweight vehicle, wherein the vehicle generally comprises a chassis, a passenger compartment supported by the chassis, a plurality of wheels, and a powertrain operatively connected to at least one of the wheels. In various instances the powertrain comprise a driveline that comprise an axle assembly operably connected to the at least one of the wheels, and a transaxle and/or a transmission operably connected to the axle assembly. The lightweight vehicle additionally comprises a prime mover operably connected to the driveline, wherein the prime mover is structured and operable to generate and deliver power to the driveline. The driveline is structured and operable to receive the generated power and deliver the power to the at least one wheel. In various instances the prime mover comprises an internal combustion engine that is structured and operable to generate the power delivered to the driveline, and a starter motor that is integrally integrated with the internal combustion engine, wherein the starter motor structured and operable to start the internal combustion engine.

In various other embodiments, the present disclosure provides a method of operating a prime mover for a lightweight vehicle, wherein the prime mover comprises a housing and a starter motor integrally integrated with an internal combustion engine that is disposed within the housing. The prime mover is structured and operable to generate and deliver power to a driveline of the lightweight vehicle to provide motive force to the lightweight vehicle. In various embodiments, the method comprises starting the internal combustion engine via the starter motor integrally integrated with the internal combustion engine, wherein a starter motor is enclosed within a starter motor portion of the housing, and the starter motor portion of the housing comprises a shroud and a cover connectable to the shroud to enclose the starter motor therebetween. In such embodiments the method additionally comprises generating and delivering power to the driveline via the internal combustion engine integrally integrated with the starter motor, wherein at least a portion of the internal combustion engine is enclosed within an internal combustion engine portion of the housing. In such embodiments, the method further comprises determining when operation of the internal combustion engine should start utilizing communications of an prime mover control module of the prime mover to with a Hall Effect sensor of the prime mover that is mounted to the housing, and upon the determination that operation of the internal combustion engine should start, stopping the internal combustion engine such that a piston of the internal combustion engine is positioned at between 15° and 25° after bottom-dead-center.

This summary is provided merely for purposes of summarizing various example embodiments of the present disclosure so as to provide a basic understanding of various aspects of the teachings herein. Various embodiments, aspects, and advantages will become apparent from the following detailed description taken in conjunction with the accompanying drawings which illustrate, by way of example, the principles of the described embodiments. Accordingly, it should be understood that the description and specific examples set forth herein are intended for purposes of illustration only and are not intended to limit the scope of the present teachings.

DRAWINGS

The drawings described herein are for illustration purposes only and are not intended to limit the scope of the present teachings in any way.

Corresponding reference numerals indicate corresponding parts throughout the several views of drawings.

DETAILED DESCRIPTION

Figure 1:
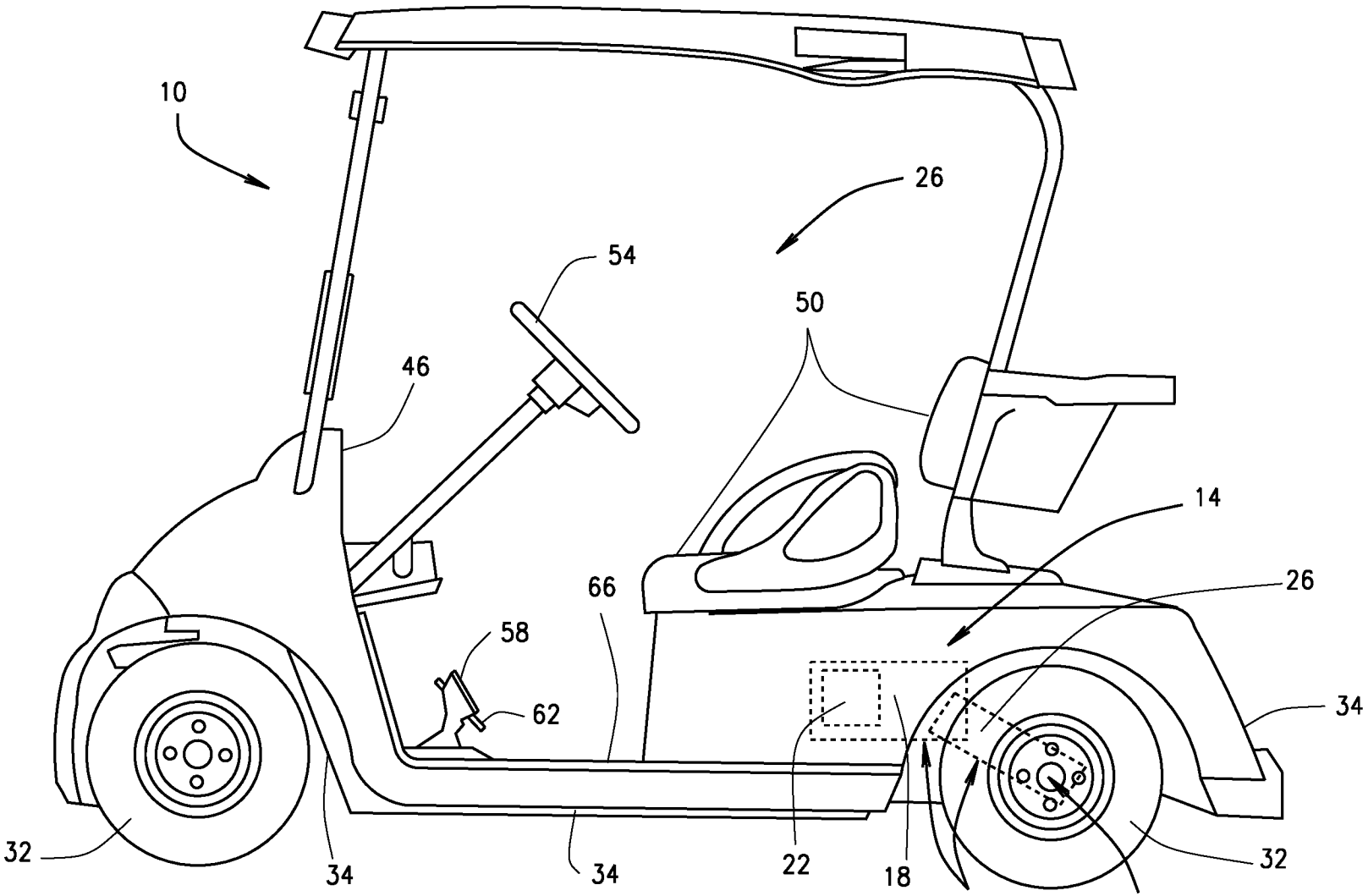
FIG. 1 is a side view of a lightweight vehicle including a prime mover comprising a starter motor integrally integrated with an internal combustion engine, in accordance with various embodiments of the present disclosure.

The following description is merely exemplary in nature and is in no way intended to limit the present teachings, application, or uses. Throughout this specification, like reference numerals will be used to refer to like elements. Additionally, the embodiments disclosed below are not intended to be exhaustive or to limit the invention to the precise forms disclosed in the following detailed description. Rather, the embodiments are chosen and described so that others skilled in the art can utilize their teachings. As well, it should be understood that the drawings are intended to illustrate and plainly disclose presently envisioned embodiments to one of skill in the art, but are not intended to be manufacturing level drawings or renditions of final products and may include simplified conceptual views to facilitate understanding or explanation. As well, the relative size and arrangement of the components may differ from that shown and still operate within the spirit of the invention.

As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims.

Unless otherwise defined, all technical and scientific terms used herein have the same meaning as commonly understood by one of ordinary skill in the art to which this disclosure belongs. The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps can be employed.

When an element, object, device, apparatus, component, region or section, etc., is referred to as being "on," "engaged to or with," "connected to or with," or "coupled to or with" another element, object, device, apparatus, component, region or section, etc., it can be directly on, engaged, connected or coupled to or with the other element, object, device, apparatus, component, region or section, etc., or intervening elements, objects, devices, apparatuses, components, regions or sections, etc., can be present. In contrast, when an element, object, device, apparatus, component, region or section, etc., is referred to as being "directly on," "directly engaged to," "directly connected to," or "directly coupled to" another element, object, device, apparatus, component, region or section, etc., there may be no intervening elements, objects, devices, apparatuses, components, regions or sections, etc., present. Other words used to describe the relationship between elements, objects, devices, apparatuses, components, regions or sections, etc., should be interpreted in a like fashion (e.g., "between" versus "directly between," "adjacent" versus "directly adjacent," etc.).

As used herein the phrase "operably connected to" will be understood to mean two are more elements, objects, devices, apparatuses, components, etc., that are directly or indirectly connected to each other in an operational and/or cooperative manner such that operation or function of at least one of the elements, objects, devices, apparatuses, components, etc., imparts are causes operation or function of at least one other of the elements, objects, devices, apparatuses, components, etc. Such imparting or causing of operation or function can be unilateral or bilateral.

As used herein, the term "and/or" includes any and all combinations of one or more of the associated listed items. For example, A and/or B includes A alone, or B alone, or both A and B.

Although the terms first, second, third, etc. can be used herein to describe various elements, objects, devices, apparatuses, components, regions or sections, etc., these elements, objects, devices, apparatuses, components, regions or sections, etc., should not be limited by these terms. These terms may be used only to distinguish one element, object, device, apparatus, component, region or section, etc., from another element, object, device, apparatus, component, region or section, etc., and do not necessarily imply a sequence or order unless clearly indicated by the context.

Moreover, it will be understood that various directions such as "upper", "lower", "bottom", "top", "left", "right", "first", "second" and so forth are made only with respect to explanation in conjunction with the drawings, and that components may be oriented differently, for instance, during transportation and manufacturing as well as operation. Because many varying and different embodiments may be made within the scope of the concept(s) herein taught, and because many modifications may be made in the embodiments described herein, it is to be understood that the details herein are to be interpreted as illustrative and non-limiting.

The prime mover and methods described herein can be controlled and implemented at least in part by one or more computer program products (e.g., a prime mover control module and/or an integrated starter control unit (ISCU), as described below) comprising one or more non-transitory, tangible, computer-readable mediums storing computer programs with instructions that may be performed by one or more processors. The computer programs may include processor executable instructions and/or instructions that may be translated or otherwise interpreted by a processor such that the processor may perform the instructions. The computer programs can also include stored data. Non-limiting examples of the non-transitory, tangible, computer readable medium are nonvolatile memory, magnetic storage, and optical storage.

As used herein, the term module can refer to, be part of, or include an application specific integrated circuit (ASIC); an electronic circuit; a combinational logic circuit; a field programmable gate array (FPGA); a processor (shared, dedicated, or group) that performs instructions included in code, including for example, execution of executable code instructions and/or interpretation/translation of uncompiled code; other suitable hardware components that provide the described functionality; or a combination of some or all of the above, such as in a system-on-chip. The term module can include memory (shared, dedicated, or group) that stores code executed by the processor.

The term code, as used herein, can include software, firmware, and/or microcode, and can refer to one or more programs, routines, functions, classes, and/or objects. The term shared, as used herein, means that some or all code from multiple modules can be executed using a single (shared) processor. In addition, some or all code from multiple modules can be stored by a single (shared) memory. The term group, as used above, means that some or all code from a single module can be executed using a group of processors. In addition, some or all code from a single module can be stored using a group of memories.

Referring now to FIG. 1, the present disclosure generally provides a lightweight vehicle 10, such as a golf car, that includes a prime mover 14 that comprises an internal combustion engine (ICE) 18 having a starter motor 22 integrally integrated therewith. In various embodiments, the prime mover 14 is operatively connected to a driveline 26, and the prime mover 14 combined with the driveline 26 comprise a powertrain 28 of the vehicle 10. The driveline 26 is structured and operable to receive power (e.g., torque) generated by the prime mover 14 (particularly by the ICE 18) and deliver the power to at least one of the wheels 32 to provide motive force the vehicle 10. In various embodiments, the driveline 26 comprises a transaxle and an axle assembly 30. In such embodiments, the transaxle is operatively coupled to the prime mover 14 and the axle assembly 30, to which one or more of the wheels 32 is/are operatively connected. In various instances, the driveline 26 can comprise a transaxle having a mounting collar to which the prime mover 14 is mounted such as that described in patent application Ser. No. 16/135,406, filed Sep. 19, 2018 and titled Floating Engine Powertrain, the disclosure of which is incorporated herein by reference in its entirety. Alternatively, in various other embodiments, the driveline 26 can a transmission (not shown, but readily understood by one skilled in the art) operatively connected to the prime mover 14 and operably connected to a differential (not shown, but readily understood by one skilled in the art) that is operatively connected to the axle assembly 30.

The powertrain 28 is structured and operable to deliver motive force to the vehicle 10. Specifically, the prime mover 14 (e.g., the ICE 18) is structured and operable to generate and deliver power (e.g., torque) to the driveline 26, thereby delivering the power/torque to the axle assembly 30. The axle assembly 30 in turn delivers the power/torque generated by the prime mover 14 to at least one wheel 32 operably connected to the axle assembly 30 (referred to herein as driven wheel(s) 32), thereby delivering motive force to the vehicle 10. In addition to the driven wheel(s) 32, the vehicle 10 can include one or more non-driven wheels 32 that is/are operationally connected to a chassis 34 or other frame structure of the vehicle 10, and/or one or more non-driven wheels 32 operationally connected to the axle assembly 30.

Although the vehicle 10 is exemplarily illustrated as a golf car throughout the various figures, it should be understood that in various embodiments, the vehicle 10 can be a maintenance vehicle, a cargo vehicle, a shuttle vehicle, an all-terrain vehicle (ATV), a utility-terrain vehicle (UTV), a worksite vehicle, a buggy, any lightweight vehicle, or any other suitable type of utility or low-speed vehicle that is not designated for use on roadways, and remain within the scope of the present disclosure.

The vehicle 10 additionally comprises a passenger compartment 36 that is mounted to and supported by the chassis 34. The passenger compartment 36 generally includes: a dash/instrument console 46 that can include such things a vehicle On/Off key switch for controlling the operation mode of the vehicle 10, a forward/neutral/reverse selector, one or more small accessory storage pockets, a speedometer, various other gauges and/or instrumentation, a radio, and/or various other vehicle controls; a seating structure 50 structured and operable to provide seating for one or more vehicle occupants; a steering wheel 54 for use by the vehicle operator to control the directional movement of the vehicle 10; a brake pedal 58 for use by the vehicle operator to control slowing and stopping of the vehicle 10; an accelerator pedal 62 for use by the vehicle operator to start the prime mover 14 (e.g., to start the ICE 18) and control the torque/power delivered by the prime mover 14 to one or more of the wheels 32; and a floorboard 66.

Additionally, although the powertrain 28 of the present disclosure will, by way of example, be shown and described herein as structured and operable to deliver motive force to the rear wheel(s) 32, via the axle assembly 30 (shown by way of example as a rear axle assembly), it should be understood that, in various embodiments, the powertrain 28 of the present disclosure can be structured and operable to deliver motive force to the front wheel(s) 32, via a front axle assembly (not shown, but readily understood by one skilled in the art), and remain within the scope of the present disclosure. In yet other embodiments, it is envisioned that powertrain 28, as described herein can be implemented in a four-wheel drive vehicle including a power take off assembly (not shown, but readily understood by one skilled in the art) operable to deliver motive force (i.e., power/torque) generated by the prime mover 14 to one or more of the front wheel(s) 32 and/or rear wheel(s) 32.

Figure 2:
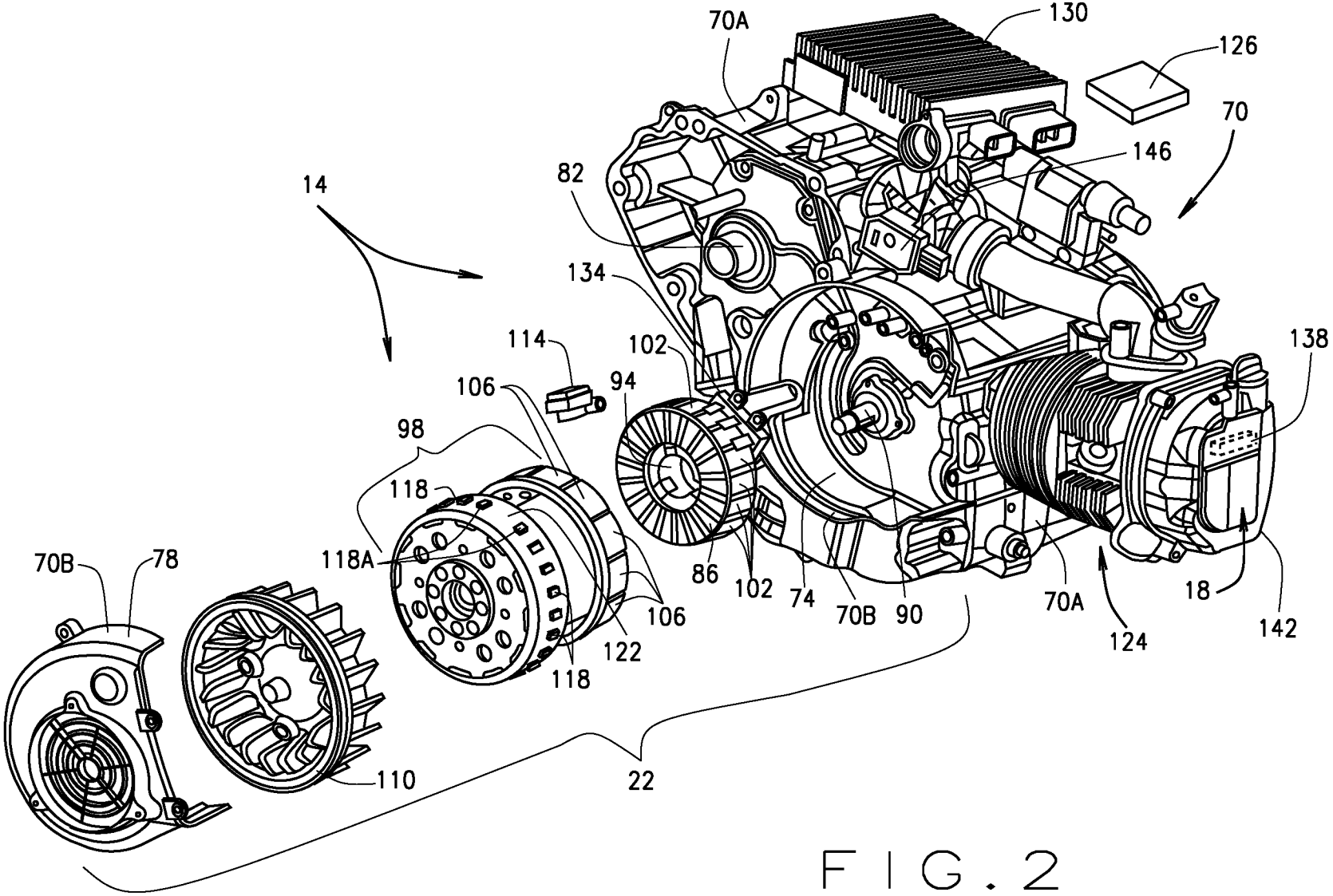
FIG. 2 is an exploded view of the prime mover of FIG. 1 comprising the starter motor integrally integrated with the internal combustion engine, in accordance with various embodiments of the present disclosure.

Referring now to FIGS. 1 and 2, as described above, the prime mover 14 comprises the integrated starter motor 22 that is integrally integrated with the combustion engine 18. In operation, the integrated starter motor 22 is structured and operable to start the internal combustion engine 18, and the internal combustion engine 18 is structured and operable to generate the power delivered to the driveline 26, thereby providing motive force to the vehicle 10. In various embodiments, the prime mover 14 comprises a housing 70 that includes an internal combustion engine portion 70A that encloses at least a portion of the internal combustion engine 18, and a starter motor portion 70B that encloses the integrated starter motor 22. In various implementations, the starter motor portion 70B comprises a shroud 74 that is either integrally formed with, or connected to, the internal combustion engine portion 70A, and a cover 78 that is connectable to the shroud 74 to define the housing starter motor portion 70B. The cover 78 can be connected or mounted to the shroud using any suitable connector or fastener, such as bolts, screws, glue, clamps, welding, etc.

The internal combustion engine 18 can be any small engine suitable for generating and delivering sufficient power to the vehicle driveline 26 to provide a desired range of motive force to the vehicle 10. For example, in various embodiments the internal combustion engine 18 can comprise one or more cylinders having a displacement volume of 100 to 500 cubic centimeters (CC). Particularly, in various instances, the internal combustion engine can be a single cylinder engine having a displacement volume of 100 to 250 CC, e.g., 150 CC. The internal combustion engine 18 comprises an output shaft 82 that is connectable to the driveline 26. In operation, when the output shaft 82 is coupled to the driveline 26, the internal combustion engine 18 generates the power/torque that is output to the driveline 26 by the output shaft 82. As described above, the driveline 26 can be configured in any desired manner including any desired combination and configuration of common driveline components, such as a transaxle and/or a transmission, and/or a differential, and/or one or more drive shafts, etc. The output shaft 82 can be coupled to any desired component of the driveline 26 depending on the respective driveline configuration. For example, in various embodiments, the internal combustion engine output shaft 82 can be directly coupled to an input shaft of a transaxle as described in co-pending patent application Ser. No. 16/135,406, filed Sep. 19, 2018 and titled Floating Engine Powertrain, the disclosure of which is incorporated herein by reference in its entirety.

In various embodiments, the integrated starter motor 22 comprises a stator 86 mounted to the combustion engine portion 70A of the housing 70 within the shroud 74 of starter motor portion 70B of the housing 70. More specifically, the stator 86 has an annular shape and is mounted to the combustion engine portion 70A such that a crankshaft 90 of the internal combustion engine 18 extends through a center aperture 94 of the stator 86. The integrated starter motor 22 additionally comprises a rotor 98 that is mounted to the crankshaft 90 over and around the stator 94 such that stator 94 is disposed within an interior space of the rotor 98. The rotor 98 is mounted to the crankshaft 90 such that rotation of the rotor 98 will rotate or turn the crankshaft 90, and rotation of the crankshaft 90 will rotate or turn the rotor 98. The stator 86 comprises a plurality of field coils 102 that can be energized by electrical energy provided by a battery source of the vehicle (not shown, but readily understood by one skilled in the art). The rotor 98 comprises a plurality of permanent magnets 106 mounted to and disposed around a cylindrical sidewall of the rotor 98. Hence, the rotor 98 is mounted to the crankshaft 90 such that the rotor 98 is disposed around and/or over the stator 86. Therefore, the permanent magnets 106 of the rotor 98 are disposed radially outward from, adjacent and in close proximity to the field coils 102 of the stator 86.

Accordingly, when a vehicle operator causes electrical current to flow through the stator field coils 102 (e.g., by depressing the accelerator pedal 62), the field coils 102 will be energized and generate a magnetic flux field that repulses and/or attracts the rotor permanent magnets 106, thereby causing the rotor 98 to rotate about the stator 94. Moreover, the rotation or turning of the rotor 98 will cause the crankshaft 90 to turn or rotate, and thereby start the internal combustion engine 18. In various embodiments, the integrated starter motor 22 additionally includes a fan 110 mounted to the rotor 98 such that rotation of the rotor 98 will operate the fan 110 to cool the integrated starter motor 22.

In various embodiments, the integrated starter motor 22 further comprises a variable reluctance (VR) sensor 114, that in various instances can be mounted to the combustion engine portion 70A of the housing 70 within the starter motor portion shroud 74. Additionally, in such embodiments, a plurality of crankshaft alignment teeth 118 can be disposed on and around the outer surface of the cylindrical sidewall of the rotor 98. The teeth 118 are disposed on, or integrally formed, around the outer surface such that all the teeth 118 are evenly spaced apart except for one set of adjacent teeth 118A that are further spaced apart than all the other adjacent teeth 118 (e.g., one tooth is has been removed), such that an alignment gap 122 is provided between the one set of teeth 118A. Importantly, the rotor 98 is mounted to the crankshaft 90 such that when the rotor 98 is stopped (i.e., operation of the internal combustion engine 18 is ceased) the alignment gap 122 is positioned, oriented or aligned in a particularly relation with the VR 114 (e.g., when a center of the alignment gap 122 is aligned with a center of the VR sensor). Particularly, when the alignment gap 122 is positioned, oriented or aligned in the particularly relation with the VR sensor 114, one or more piston(s) 124 of the internal combustion engine 18 will be at a Home position within the stroke of the respective piston(s). For example, in various instances, when the rotor 98 is stopped (i.e., operation of the internal combustion engine 18 is ceased) and the center of the alignment gap 122 is aligned with a center of the VR sensor, the one or more piston(s) will be at the Home position, which is approximately 5° to 35° (e.g., approximately 15° to 25°, e.g., approximately 20°) after bottom-dead-center. Furthermore, the VR sensor 114 is disposed in alignment and proximity to the teeth 118 such that the VR sensor 114 can sense the teeth 118 as the rotor 98 turns, and more particularly, can sense the location of the alignment gap 122. For example, the teeth 118 can generate magnetic pulses sensed by the VR sensor 114 as the rotor 98, and hence the crankshaft 90, turns. One skilled in the art will readily recognize the internal combustion engine piston(s) is/are connected to the crankshaft 90 such that rotation of the crankshaft will operated the piston(s), and operation of the piston(s) will rotate the crankshaft 90.

In such embodiments, the prime mover 14 includes an electronic prime mover control module (PMCM) 126 that is a computer based module. It is envisioned that the PMCM 126 can be a hardware based module that is structured and operable to implement prime mover control command functionality as described herein. It should be understood that, although the various prime mover control operations and functionality may be described herein as being implemented or carried out by PMCM 126, it will be appreciated that in some embodiments the PMCM 126 may indirectly perform and/or control performance of such operations and functionality by generating commands and control signals that can cause other elements to carry out the control operations and functionality described herein. For example, in the various executable software embodiments, it is the execution of the prime mover control command software by one or more processors of the PMCM 126 that can generate the prime mover control commands that are then output by the PMCM 126 to control the operations and functions of the prime mover 14 as described herein. Or, in the various hardware embodiments, it is the operation of the various PMCM 126 hardware components that can generate the prime mover control commands that are then output by the PMCM 126 to control the operations and functions of the prime mover 14 as described herein.

The PMCM 126 communicates with and controls the operation of various instruments, components, and systems of the vehicle 10. For example, the PMCM 126 can communicate with an integrated starter control unit (ISCU) 130 and/or the Hall Effect sensor 134, and/or a current flow control unit (not shown, but readily understood by one skilled in the art) that is operable to control the flow of electrical current to the stator field coils 102. As described further below, by controlling the operation of the current flow control unit, the PMCM 126 can control energizing of the stator field coils 102 to control the position, orientation or alignment of the alignment gap 122 with the VR sensor 114 in order to control rotational position of the crankshaft 90, and more particularly the positioning, or power phase, of one or more piston 124 of the internal combustion engine 18.

The PMCM 126 is structured and operable to communicate with various sensors, components, and systems of the internal combustion engine 18 and control various operations of the internal combustion engine 18. For example, in various instances the ISCU 130 is operable to communicate with a throttle body sensor 146 of the internal combustion engine 18. The throttle body sensor 146 is operable to measure barometric pressure of an air passage or manifold (not shown, but readily understood by one skilled in the art) of the internal combustion engine 18, which can be utilized by the PMCM 126 to determine whether the piston(s) of the internal combustion engine 18 are in a power or exhaust stroke (i.e., determine the power phase of the piston(s)). In various embodiments, the PMCM 126 is additionally operable to communicate with the accelerator pedal 62 and/or brake pedal 58 and/or the ISCU 130. Moreover, via the communication with the ISCU 130, and/or the accelerator pedal 62 and/or brake pedal 58, the PMCM 126 can determine when a vehicle operator desires to cease operation of the internal combustion engine 18, e.g., the operator wishes to stop movement of the vehicle 10.

Additionally, in various embodiments, the prime mover 14 comprises a Hall Effect sensor 134 mounted to the stator 86. The Hall Effect sensor 134 communicates with the ISCU 130 and/or the PMCM 126, and is operable to measure the magnetic reluctance, or magnetic pulses, of the rotor magnets 106. By monitoring the magnetic reluctance, or magnetic pulses, of the rotor magnets 106, the ISCU 130 and/or the PMCM 126 can determine the rotational position of the rotor 98, and thereby monitor the position (or power phase) of the internal combustion engine piston(s). Hence, in various embodiments, via communication with the accelerator pedal 62 and/or the brake pedal 58 and/or the ISCU 130, the PMCM 126 can determine when it is desired that operation of the internal combustion engine 18 be ceased. Then, upon determination that it is desired that operation of the internal combustion engine 18 cease, the PMCM 126 can utilize the communication with the VR sensor 114, and/or the ISCU 130, and/or the Hall Effect sensor 134 to control the operation of the current flow control unit to control the energizing of the stator field coils 102. By controlling the current flow to the stator field coils, the PMCM 126 can control the rotation of the rotor 98 and crankshaft 90 to align the alignment gap 122 with the VR sensor 114, and/or (via the Hall Effect sensor 134) adjust the barometric pressure within the air passage or manifold of the internal combustion engine 18 such that the piston(s) of the internal combustion engine 18 will be stopped at the Home is position (i.e. at between 5° and 35° after bottom-dead-center, e.g., between 15° and 25° after bottom-dead-center, e.g., approximately 20° after bottom-dead-center). By positioning the internal combustion engine piston(s) at the Home position when the operation of the internal combustion engine is turned Off (e.g., cease operation), the compression within the piston cylinder(s) will provide resistance to movement of the vehicle 10 once the brake 58 is disengaged and the integrated starter 22 is operated to start the internal combustion engine 18.

In various embodiments, the ISCU 130 can be configured and operable to implement a power management function, wherein the ISCU 130 communicates with the vehicle On/Off key switch and provides the vehicle On/Off key switch setting input to the PMCM 126, which enables the ISCU 130 to power down the PMCM 126 based on time and/or vehicle key switch state/position. An additional feature added to the ISCU 130 is an accessory relay driver wherein the ISCU 130 is operable to power down electrical vehicle accessories as part of the overall power management scheme of the vehicle 10.

In various embodiments, the prime mover 14 further comprises one or more decompression mechanism 138 that is/are mounted to the internal combustion engine 18 and is/are in fluid communication with the piston cylinders of the internal combustion engine 18. More specifically, in various instances the decompression mechanism(s) 138 is/are mounted inside one or more valve cover 142 of the internal combustion engine 18 and can be part of an overhead cam system (not shown, but readily understood by one skilled in the art) of the internal combustion engine 18. The decompression mechanism 138 is a mechanical system and is structured and operable to open one or more intake valve (not shown, but readily understood by one skilled in the art) of the internal combustion engine 18 during initial rotation of the internal combustion engine crankshaft 90 by the starter motor 22 such that compression cannot occur within a piston cylinder of the internal combustion engine 18 during rotation of the crankshaft 90 by the starter motor 22 to start the internal combustion engine 18. Particularly, the decompression mechanism(s) 138 hold(s) the exhaust valved (not shown, but readily understood by one skilled in the art) of the piston cylinder(s) open until the crankshaft 90 of the internal combustion engine spins at a desired RPMs (e.g., 600-1500 RPMs, e.g., 900-1000RPMs), after which the decompression mechanism(s) 138 allow(s) the exhaust valves to close and create compression within the piston cylinder(s).

In various embodiments, the integrated starter motor 22 is structured and operable to function as an electrical generator once the internal combustion engine 18 has been started by the integrated starter motor 22. Particularly, once the internal combustion engine 18 has been started and is operating, the motive forced (e.g., power and/or torque) generated by the operating internal combustion engine 18 will turn the crankshaft 90, which in turn will rotate the rotor 98. As is readily understood by one skilled in the art, rotation of the rotor 98 about the stator 94, when current is not being applied to the stator field coils 102, will induce current in the stator filed coils 102, thereby generating electrical power that can be used to operate one or more electrical systems, apparatuses, devices and/or components of the vehicle 10. It is also envisioned that in various embodiments, the rotor 98 can function as a fly wheel to balance the forces generated by and action on the internal combustion engine 18. For example, on a power stroke side of movement of the piston(s) 124, the internal combustion engine 18 can generate of forces that act on the internal combustion engine 18. However, on an exhaust stroke side of movement of the piston(s) 124, the internal combustion engine 18 will not generated such forces. In such instances, the rotor 98 will act as fly wheel that generates inertia forces that will balance the power stroke forces.

The integrated starter motor/generator 22 can be any type of suitable motor/generator that is integrally integrated with the internal combustion engine 18, and remain within the scope of the present disclosure. For example, in various embodiments the integrated starter motor/generator 22 a non-contact/brushless and/or bearingless motor.

The description herein is merely exemplary in nature and, thus, variations that do not depart from the gist of that which is described are intended to be within the scope of the teachings. Moreover, although the foregoing descriptions and the associated drawings describe example embodiments in the context of certain example combinations of elements and/or functions, it should be appreciated that different combinations of elements and/or functions can be provided by alternative embodiments without departing from the scope of the disclosure. Such variations and alternative combinations of elements and/or functions are not to be regarded as a departure from the spirit and scope of the teachings.

What is claimed is:

1. A lightweight vehicle, said vehicle comprising:
- a chassis;
- a passenger compartment supported by the chassis, the passenger compartment comprising an accelerator pedal and an accelerator pedal position sensor;
- a plurality of wheels; and
- a powertrain operatively connected to at least one of the wheels, the powertrain comprising:
  - a battery;
  - an electronic control module;
  - a transaxle; and
  - an internal combustion engine structured and operable to generate power delivered to the transaxle, the internal combustion engine comprising:
    - an internal combustion engine housing;
    - a crankshaft; and
    - a starter generator integrated with the internal combustion engine, the starter generator comprising a stator mounted directly to an internal combustion engine portion of the internal combustion housing and a rotor directly mounted to the crankshaft, wherein the electronic control module is structured to receive input from the accelerator pedal position sensor and operable to send electric starting current from the battery to the stator as a result of an operator depressing the accelerator pedal.

2. The vehicle of claim 1 wherein the starter generator further comprises a fan mounted to the rotor.

3. The vehicle of claim 1, wherein the passenger compartment further comprises:
- a brake pedal; and
- a brake pedal position sensor,
- wherein the electronic control module is structured to receive input signal from the brake pedal position sensor and operable to cease operation of the internal combustion engine based on input signal from the accelerator pedal position sensor and brake pedal position sensor.

4. The vehicle of claim 3, wherein the starter motor further comprises a variable reluctance (VR) sensor mounted to the internal combustion engine housing.

5. The vehicle of claim 4, wherein the starter motor further comprises a pulsar sensor mounted to the stator.

6. The vehicle of claim 5, wherein the prime mover further comprises a prime mover control module that is structured and operable to:
- communicate with at least one of the VR sensor and the pulsar sensor; and
- determine when operation of the internal combustion engine should cease; and
- upon the determination that operation of the internal combustion engine should cease, utilize the communication from the VR sensor to stop the internal combustion engine such that a piston of the internal combustion engine is positioned at between 5° and 35° after bottom-dead-center.

7. The vehicle of claim 1, wherein the passenger compartment further comprises a vehicle On/Off key switch and at least one electronic accessory, wherein the electronic control module is operable to communicate with the vehicle On/Off key switch and provide electrical current from the battery to the at least one electronic accessory based on the vehicle On/Off key switch position.

8. The vehicle of claim 1, wherein the starter generator is structured and operable to function as a generator to generate electrical power usable by at least one of systems, apparatus, devices and components of the vehicle once the internal combustion engine has been started by the starter.

* * * * *